US005666986A

United States Patent [19]

Fox

[11] Patent Number: 5,666,986

[45] Date of Patent: Sep. 16, 1997

[54] TENT FRAME DEVICE

[75] Inventor: Clifford Royston Fox, Chelmsford, United Kingdom

[73] Assignee: Fox Design International Limited, Chelmsford, England

[21] Appl. No.: 447,911

[22] Filed: May 23, 1995

[30] Foreign Application Priority Data

May 26, 1994 [GB] United Kingdom ..... 9410539

[51] Int. Cl.[6] ..... E04H 15/36

[52] U.S. Cl. ..... 135/135; 135/98; 135/147; 135/136; 135/30; 135/156; 403/218

[58] Field of Search ..... 135/124, 135, 135/136, 138, 147, 156, 158, 159, 98, 44, 30; 403/218, 102, 170, 353

[56] References Cited

U.S. PATENT DOCUMENTS

| | | | |
|---|---|---|---|
| 3,810,482 | 5/1974 | Beavers | 135/147 |
| 4,092,809 | 6/1978 | Bellas et al. | 135/138 X |
| 4,201,237 | 5/1980 | Watts et al. | 135/30 X |
| 4,637,748 | 1/1987 | Beavers | 135/147 X |
| 4,750,509 | 6/1988 | Kim | 135/98 X |
| 4,966,178 | 10/1990 | Eichhorn | 135/98 X |
| 4,981,387 | 1/1991 | Younjae | 135/135 X |
| 4,998,552 | 3/1991 | Niksic et al. | 135/136 X |
| 5,069,572 | 12/1991 | Niksic | 135/147 X |
| 5,226,440 | 7/1993 | Fuhrman | 135/159 |
| 5,328,286 | 7/1994 | Lee | 135/135 X |

*Primary Examiner*—Wynn E. Wood

*Attorney, Agent, or Firm*—Dickinson, Wright, Moon, Van Dusen & Freeman

[57] ABSTRACT

A tent frame device comprising a hub from which radiates a multiplicity of ribs when the device is in use. The hub is provided with a multiplicity of retaining portions which extend in a tangential direction and which are spaced apart around the hub. A multiplicity of abutment portions are positioned outwardly of the retaining portions respectively. Respective rib-end portions are provided with respective recesses which are open in an intended upward direction and which receive the retaining portions respectively when the device is in use. The undersides of the rib-end portions abut the abutment portions. The invention extends to a tent frame comprising such a hub device and a multiplicity of ribs which radiate from the hub when the device is in use. It also extends to a frame having ribs which can each be folded at one or more joints having engagement means which maintain the relative orientation of the different parts of the rib. It also extends to a joint between two rib parts, the joint having male and female parts and the male part having a portion which is resiliently urged towards the female part, and which is retractable to enable diengagement between the parts.

15 Claims, 13 Drawing Sheets

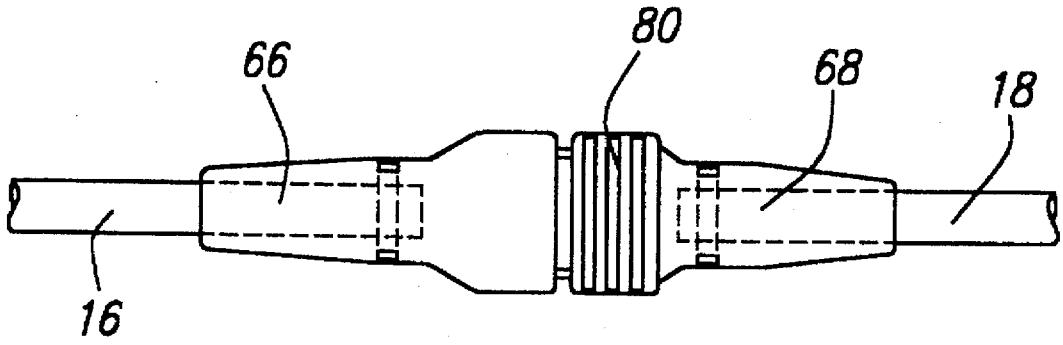
FIG. 9
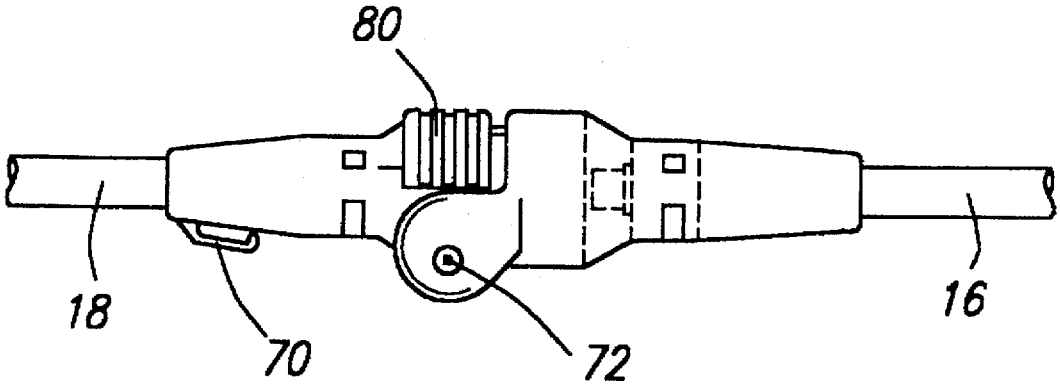
FIG. 10
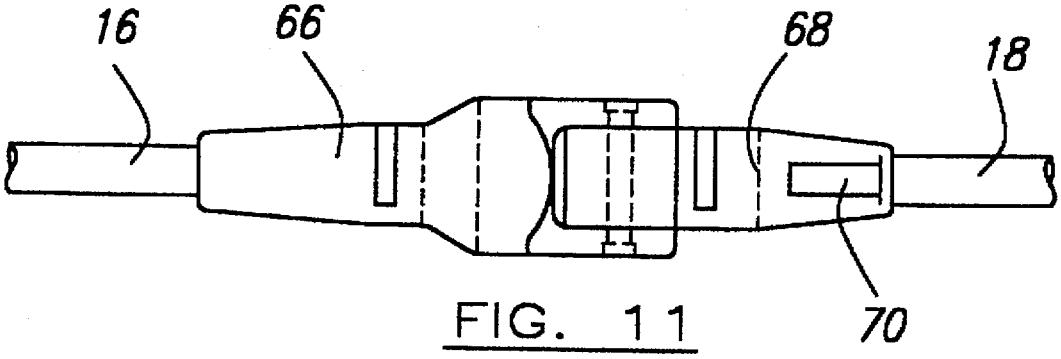
FIG. 11
FIG. 12
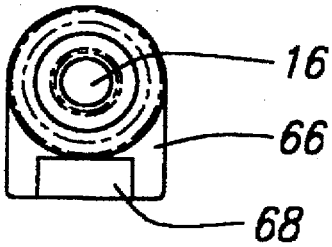

TENT FRAME DEVICE

The present invention relates to a tent or canopy frame device comprising a hub from which radiate a multiplicity of ribs when the device is in use.

One such device is described and illustrated in U.S. Pat. No. 4,750,509. This describes a hub having the appearance of an ash-tray, so that it has an annular portion with radiating channels for receiving portions close to the ends of the rods. The hub also has a central raised portion with recesses for receiving the rod ends respectively in register with the channels of the annular portion. Each recess has opposing walls, each of which has a keyhole-shaped slot open at the intended bottom edge of the wall to receive respective spigots on opposite sides of the rod end. When the latter is fully engaged in the hub, the spigots snap into the upper blind ends of the keyhole-shaped slots to resist further upward movement of the rod end, whilst downward movement is resisted by the annular portion at the associated channel thereof.

Such a construction is relatively complex to make, particularly in view of the slots required, and is also adversely affected by wear, especially at the spigots and slots. Such wear may occur both when the tent is erected for use and collapsed for stowage, and also through buffering winds when the tent is in use.

The present invention seeks to obviate these disadvantages.

Accordingly, a first aspect of the present invention is directed to a device having the construction set out in the opening paragraph of the present specification, in which the hub is provided with a multiplicity of retaining portions which extend in a tangential direction and which are spaced apart around the hub, and a multiplicity of abutment portions positioned outwardly of the retaining portions respectively, the device further comprising respective rib-end portions provided with respective recesses which are open in an intended upward direction and which receive the retaining portions respectively when the device is in use, with the undersides of the rib-end portions abutting the abutment portions.

The retaining portions may each comprise a bar having both of its ends attached to or integral with the main body of the hub.

Each bar is preferably of generally circular cross-section.

It is desirable to have each retaining portion extending across an associated aperture of the hub.

The hub is preferably of generally circular shape.

The abutment portions may extend around the periphery of the hub.

It is possible to provide respective retaining inserts attached to the rib-end portions over the retaining portions when the latter are received in the said recesses, to inhibit removal of the rib-end portions from the hub.

The rib-end portions may be made separately from such ribs, and connected to the intended inner ends of such ribs when in use.

The rib-end portions may be at least partly hollow and generally cylindrical to receive the intended inner ends of such ribs when in use.

Each of the said recesses in the rib-end portions may comprise a channel which extends transversely of the rib-end portion and which is generally U-shaped in cross-section with the arms of the "U" spaced apart by a distance which is substantially the same as the cross-sectional diameter of the associated retaining portion, thereby to inhibit twisting of the associated rib when the frame is assembled.

Also, the contact between the rib-end portion and the retaining bar is relatively large as a result, thus further reducing wear.

A second aspect of the present invention is directed to a tent or canopy frame comprising a hub device made in accordance with the first aspect of the present invention and a multiplicity of ribs which radiate from the hub when the device is in use.

A third aspect of the present invention is directed to a tent or canopy frame comprising a hub from which radiate a multiplicity of ribs when the frame is in use, each rib comprising a plurality of parts which may be folded up against one another, in a given imaginary plane, at one or more joints between such parts, in which at least the inner such part of each rib is provided at both ends with formations which may be brought into registration with corresponding formations or respective connecting parts which are at the hub and the joint, to ensure a correct orientation of the joint relative to the hub.

Preferably, the formations comprise respective holes or recesses into which a portion of a circlip may be inserted.

Such a tent or canopy frame may have its hub in accordance with the first aspect of the present invention.

A fourth aspect of the present invention is directed to a tent or canopy comprising a tent frame in accordance with the second or third aspects of the present invention, in which the ribs are attached to the hub to extend outwardly therefrom and downwardly therefrom with sheet material being attached to the frame to create a tent or canopy with the frame outside and above it.

A fifth aspect of the present invention is directed to a joint device for receiving respective ends of rib parts of a rib of a tent or canopy frame, the device comprising two joint parts pivotally connected to one another, the said ends being connected respectively to the two joint parts, one of which has a male retaining part and the other a female retaining part, a portion of the male retaining part being urged towards the female retaining part by resilient means so that the rib can be straightened at the joint when the device is in use by moving the said portion of the male retaining part against the force of the resilient means, straightening the rib so that the male part is received in the female part, and releasing the said portion so that the male and female retaining parts engage one another to retain the rib in its straight condition.

Preferably, the said portion of the male retaining part is on the opposite side of the device to the pivot between the two joint parts, and is provided with serrations or other formations which engage corresponding serrations or other formations on the inside of the female retaining part, there being a clearance between the male retaining part and the female retaining part on the pivot side of the device, whereby a bending force, applied to the device on the opposite side to that of the pivot, tends to close the space between the male and female portions, to disengage the serrations or other formations between the said portion of the male retaining part and the inside of the female retaining part, to enable the said portion of the male retaining part to be moved against the force of the resilient means, and thereby to enable the two joint parts to be rotated relative to one another about the pivot so that the male retaining part is moved out from the female retaining part.

Such a joint device is especially strong and resistant to wear, whilst at the same time being readily releasable for folding.

Examples of devices, frames, and a tent or canopy made in accordance with the present invention will now be described with reference to the accompanying drawings in which:

FIG. 9 shows a plan view of an upper joint of the frame of the tent shown in FIG. 1;

FIG. 10 shows a side view of the joint shown in FIG. 9;

FIG. 11 shows an underneath view of the joint shown in FIGS. 9 and 10;

FIG. 12 shows an end view of the joint shown in FIGS. 9 and 10;

Figure 1:
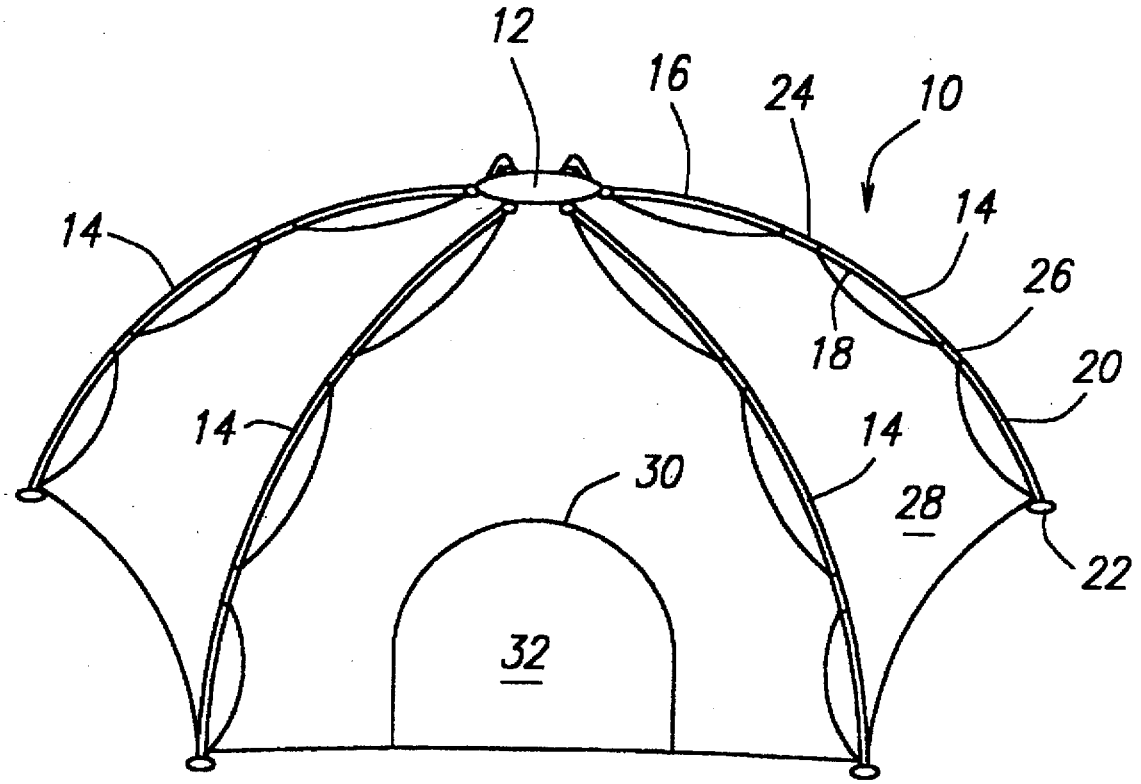
FIG. 1 shows a perspective view from above of a tent embodying the present invention.
Figure 2:
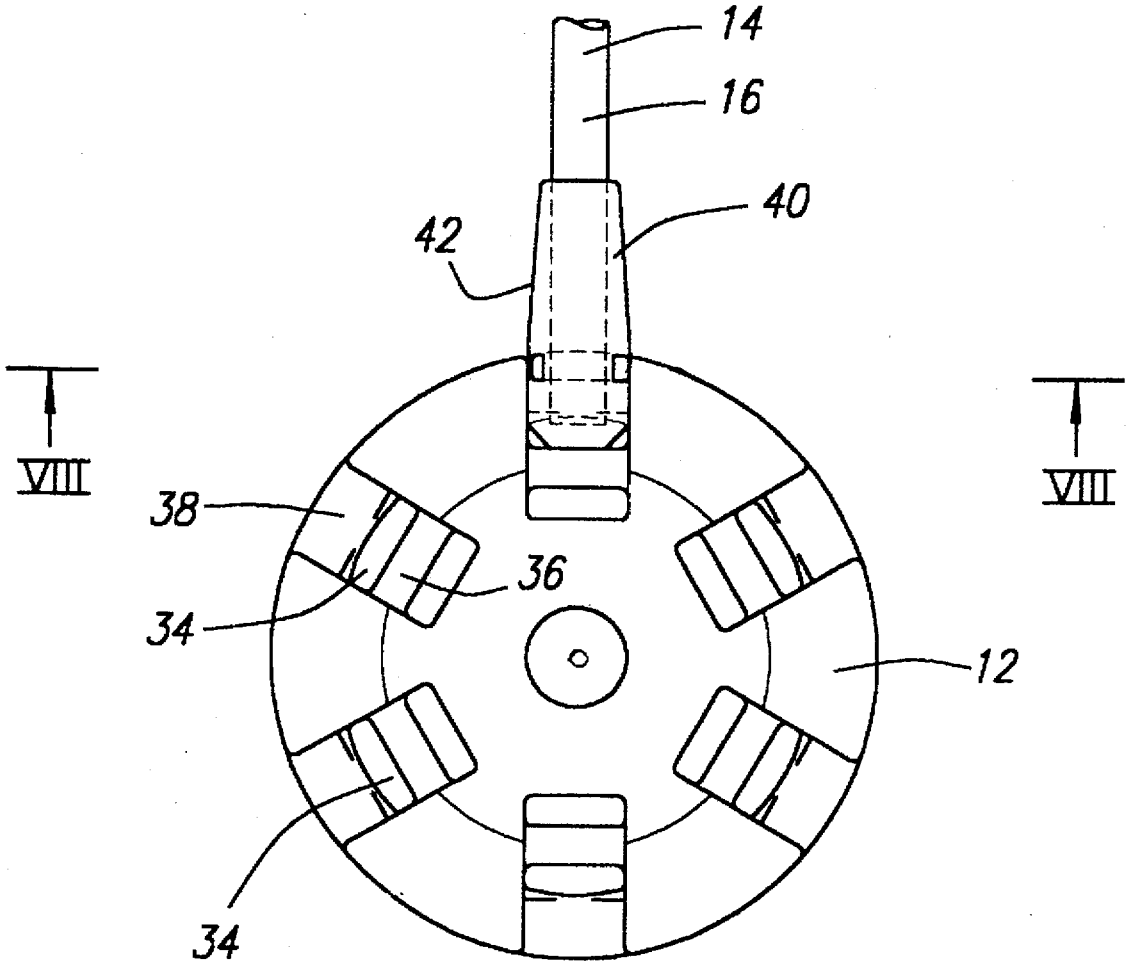
FIG. 2 shows a view from above of a central hub of the frame of the tent shown in FIG. 1, with part of one rib only extending outwardly therefrom.
Figure 3:
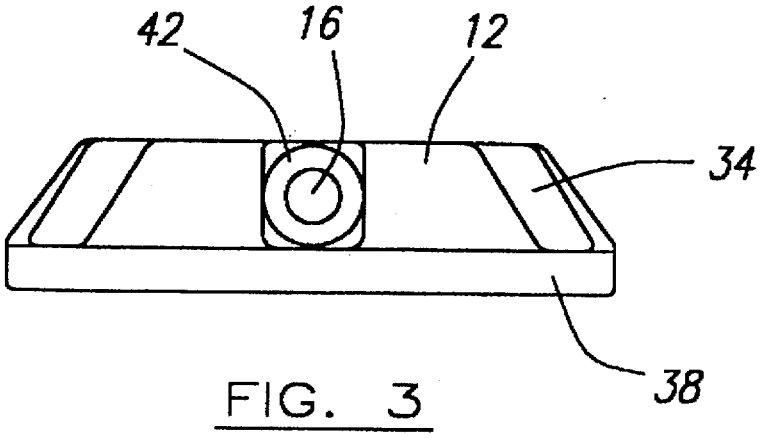
FIG. 3 shows a side view of the hub and rib shown in FIG. 2.

The tent shown in FIG. 1 comprises a relatively rigid frame 10 as a superstructre which has a generally central synthetic plastics one-piece injection-moulded hub 12 to which are attached and from which extend radially outwardly six compound ribs Each compound rib comprises three elongate fibre-glass rod sections, being an upper section 16, an intermediate section 18 and a bottom section 20. Each is generally circular in cross-section with a diameter of substantially 10 mm.

Each rib 14 as a whole forms an arc which curves outwardly and downwardly from the hub 12 to an associated foot 22 on the ground. Each upper rod section 16 is connected to its associated intermediate rod section 18 by means of a synthetic plastics upper joint 24, and each intermediate section 18 is connected to each bottom section 20 by means of a lower joint 26. The joints are preferably made of glass filled nylon or Verton™.

A fabric sheet material 28 is suspended from the frame 10 to create a tent, which may, for example, have a zipper 30 defining a door 32 to the interior of the tent.

The hub 12 is shown in greater detail in FIGS. 2 to 8. It is a generally flat circular device with six apertures 34 equiangularly spaced around the hub. A circularly-cross-sectioned retaining bar 36 which is moulded integrally with the rest of the hub 12 extends across or spans each aperture 34 at a level roughly halfway between the upper and lower main faces of the hub 12, and inwardly of the periphery of the hub 12. An abutment portion 38 positioned at the bottom side of the hub 12, at the periphery thereof, extends underneath each aperture 34 where it opens out on to the periphery of the hub 12.

Only one rib 14 is shown connected to the hub 12, for the sake of clarity. This connection is achieved by means of a synthetic plastics rib-end connector 40.

The connector 40 has a generally hollow cylindrical outer portion 42 having an internal cross-section substantially corresponding to the external cross-section of the glass fibre rod section 16. The latter has its inner end inserted the whole way into the hollow cylindrical portion. The outer surface of the hollow cylindrical portion 42 tapers in an outward direction so that at its outermost end it is more flush with the outer surface of the glass fibre rod section 16.

Figure 4:
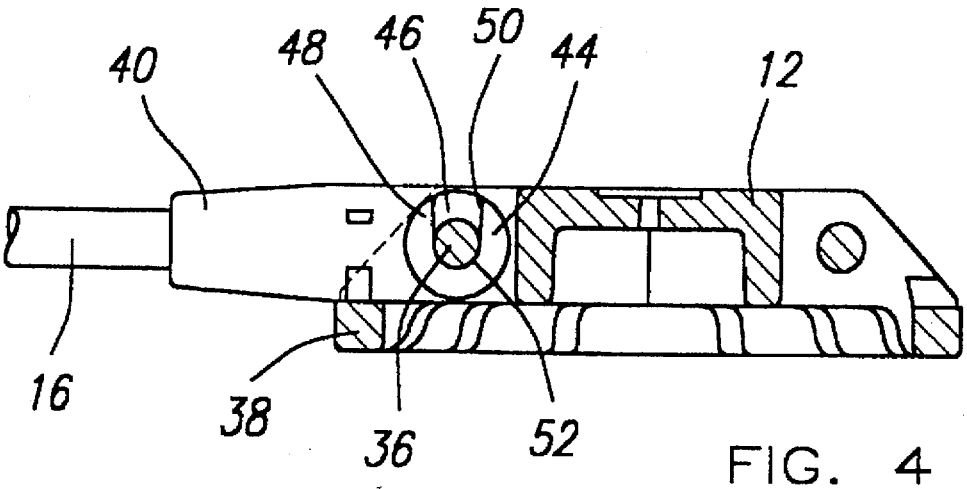
FIG. 4 shows a diametral cross-section of the hub shown in FIG. 2.
Figure 5:
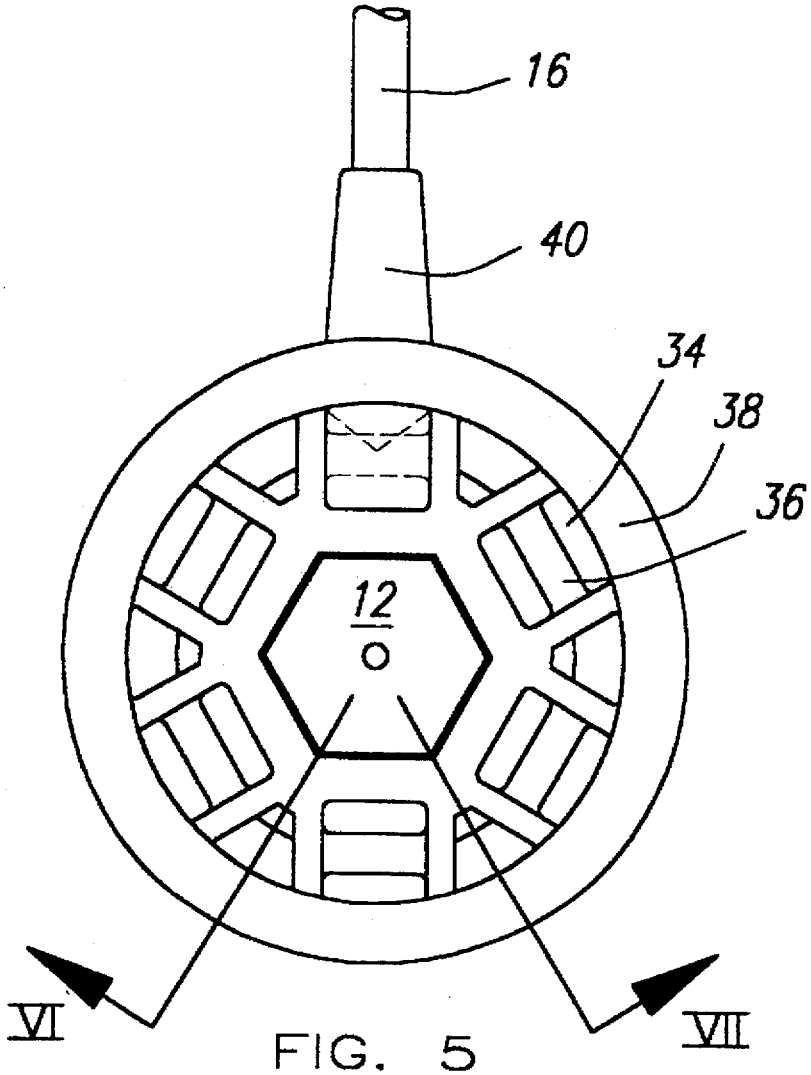
FIG. 5 shows an underside view of the hub shown in FIG. 2.
Figure 6:
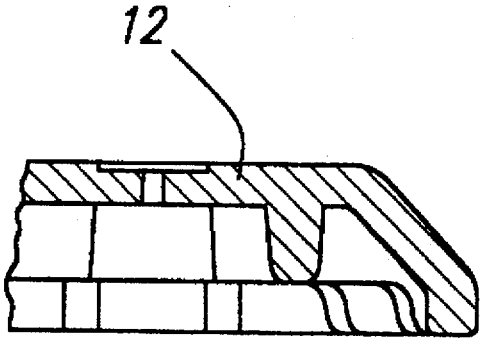
FIG. 6 shows a radial sectional view of the hub shown in FIGS. 2 to 5 on the radius VI of FIG. 5.
Figure 7:
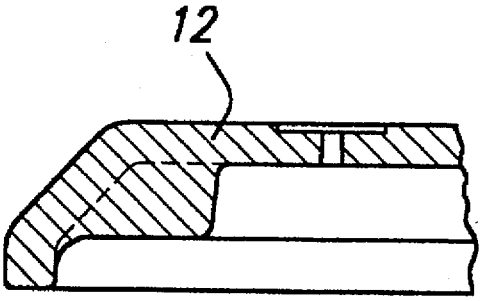
FIG. 7 shows a further radial sectional view of the hub shown in FIGS. 2 to 5 on the radius VII of FIG. 5.

The inner end 44 of the connector 40 is hook-shaped, by virtue of a transverse or tangentially extending slot 46 which has a generally U-shaped cross-section. The two arms 48 and 50 of the "U" diverge somewhat towards the mouth of the "U", and the base 52 of the "U" defines the greater part of a circle having a diameter corresponding to the diameter of the retaining bar 36. This enables the connector 40 to be snapped on to the retaining bar 36 and pivoted thereabout until an underside of the connector 40 abuts the abutment portion 38. In this position, which is shown in FIG. 4, the rod section 16 extends radially outwardly from the hub 12, and the upper surfaces of the connector 40 are substantially flush with the upper surfaces of the hub 12.

Figure 8:
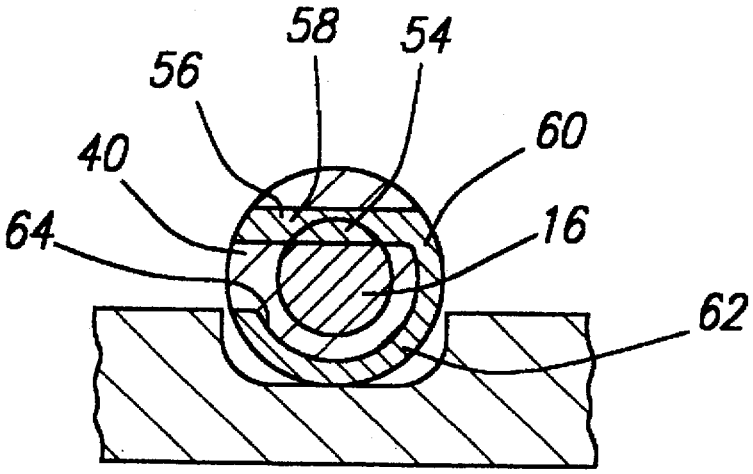
FIG. 8 shows a cross-section through the hub and rib shown in FIGS. 2 to 5 in the plane indicated by the line VIII—VIII of FIG. 2.

The manner in which the connector 40 is secured to the end of the rod 16 is shown more clearly in FIG. 8. The rod section 16 is formed with a slot 54 having a flat base which has been brought into registration with inner surfaces of a rectangularly sectioned bore 56 which extends through the wall of the generally cylindrical hollow portion of the connector 40 to define a cord of a cross-section thereof. A straight portion 58 of a circlip 60 is inserted through this bore 58 so that it also extends through the slot 54 of the rod section 16. A semicircular portion 62 of the circlip 60 fits snugly in a groove 64 around the periphery of the connector 40 so that the outside surfaces of the circlip 60 and the connector 40 are flush with one another. Since, as will be described hereinafter, each joint 24 and 26 as well as the connector to the hub 12 for each rib 14 have to be correctly orientated relative to one another, such a connection to each rod section enables this to be done at relatively low cost, and without the need for any moulding to be performed directly on to the glass fibre rods.

Each upper joint 24 of the tent frame shown in FIG. 1 is shown in greater detail in FIGS. 9 to 16. The joint 24 comprises two joint parts 66 and 68 to which are connected the outer and inner ends respectively of the upper and intermediate rod sections 16 and 18. The rod sections 16 and 18 are connected and secured to their associated joint parts 66 and 68 each in the same manner as the inner end of the rod section 16 is connected to the connector 40. The joint part 68 is also provided with a hook-like clip 70 from which may be suspended the fabric sheet material of the tent shown in FIG. 1.

The two joint parts 66 and 68 are pivotally connected together by means of a pivot 72 which has a transverse turning axis offset from the common elongate axis of the rod sections 16 and 18.

Figure 13:
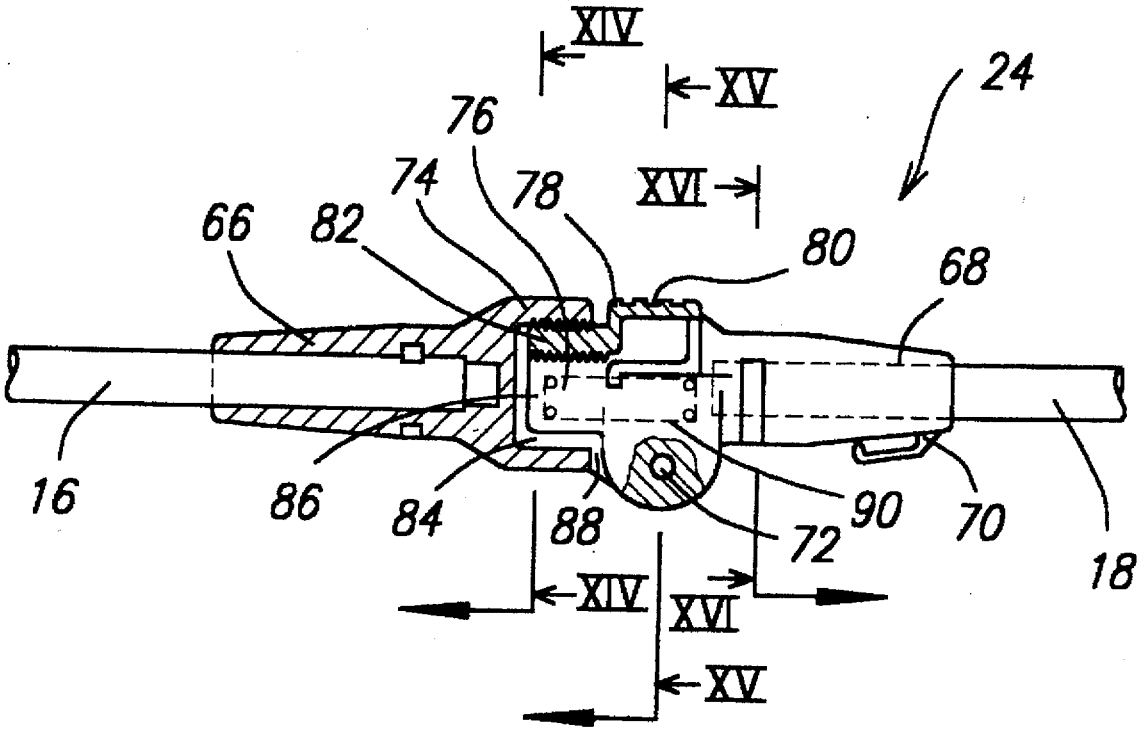
FIG. 13 shows an axial sectional view through the joint shown in FIGS. 9 and 10.
Figure 14:
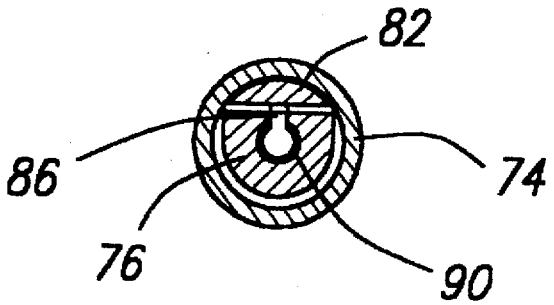
FIG. 14 shows a cross-section through the device shown in FIGS. 9 to 13 in the plane indicated by the line XIV—XIV of FIG. 13.
Figure 15:
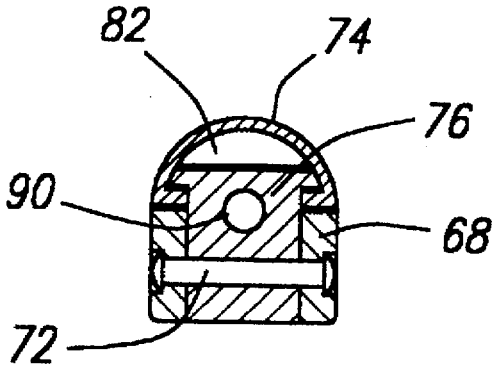
FIG. 15 shows a further cross-section of the device shown in FIGS. 9 to 13 in the plane indicated by the line XV—XV of FIG. 13.
Figure 16:
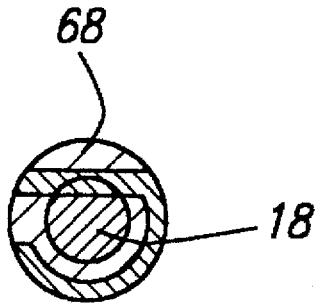
FIG. 16 shows a further cross-section of the joint shown in FIGS. 9 to 13 in the plane indicated by the line XVI—XVI of FIG. 13.

The joint part 66 has a female retaining part of the joint 74 which opens towards the joint part 68 as shown in FIG. 13. The joint part 68 has a corresponding male retaining part 76 which is received in the female retaining part 74 of the joint part 66. A slider 78 has a thumb-pad 80 extending around the outside of a portion of the joint part 68 and an inner serrated portion 82 which forms part of the male retaining part 76. Corresponding serrations on the rest of the male part 76 and also on the inside of the female part 74 engage the serrations of the slider 78. The flexure of the rib 14, as a result of the inward pull of the tent material, tends to break the joint 24 to pivot the male retaining part 76 out of engagement with the female retaining part 74. However, the interengaging serrations prevent this from happening, unless and until the user operates the slider to disengage the female and male retaining parts 74 and 76.

Figure 17:
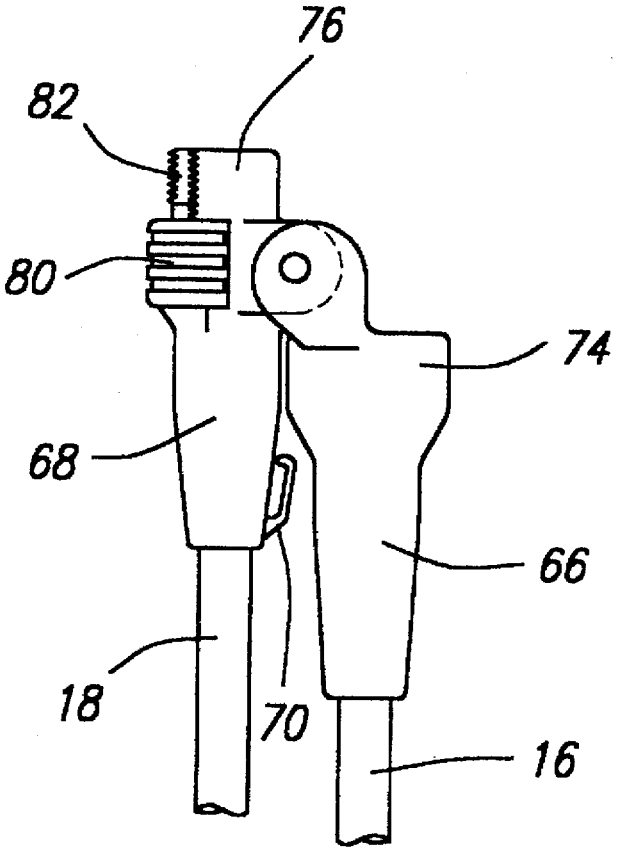
FIG. 17 shows the device shown in FIGS. 9 to 13, in a folded condition.
Figure 18:
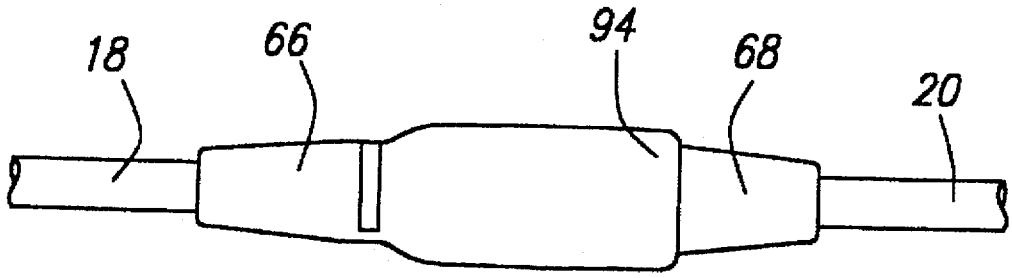
FIG. 18 shows a view of a lower joint of the frame of the tent shown in FIG. 1, viewing it from a position within the frame.
Figure 19:
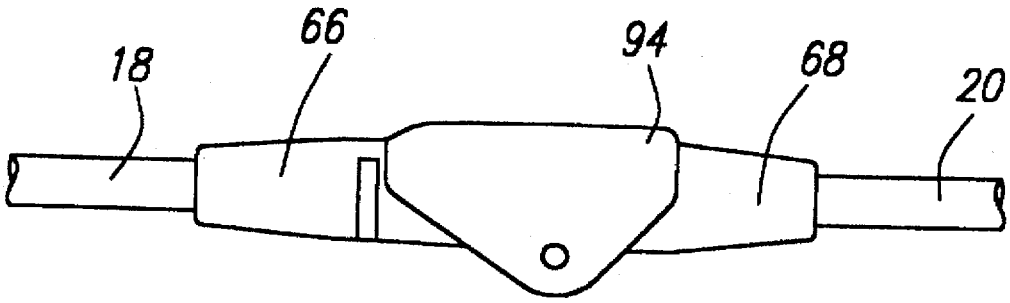
FIG. 19 shows a side view of the joint shown in FIG. 18.
Figure 20:
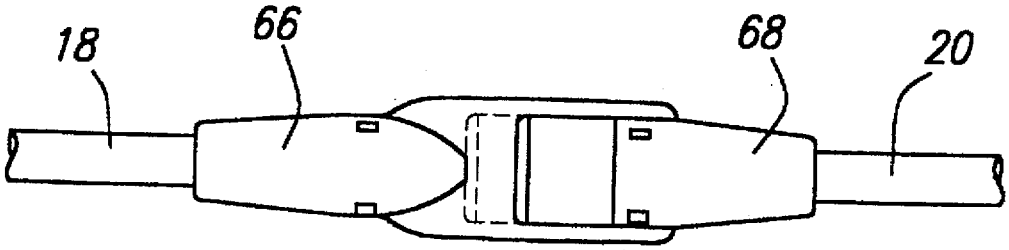
FIG. 20 shows a view from the outside of the frame of the joint shown in FIGS. 18 and 19.
Figure 21:
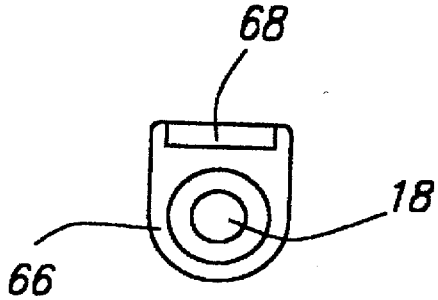
FIG. 21 shows an end view of the joint shown in FIGS. 18 to 20.
Figure 22:
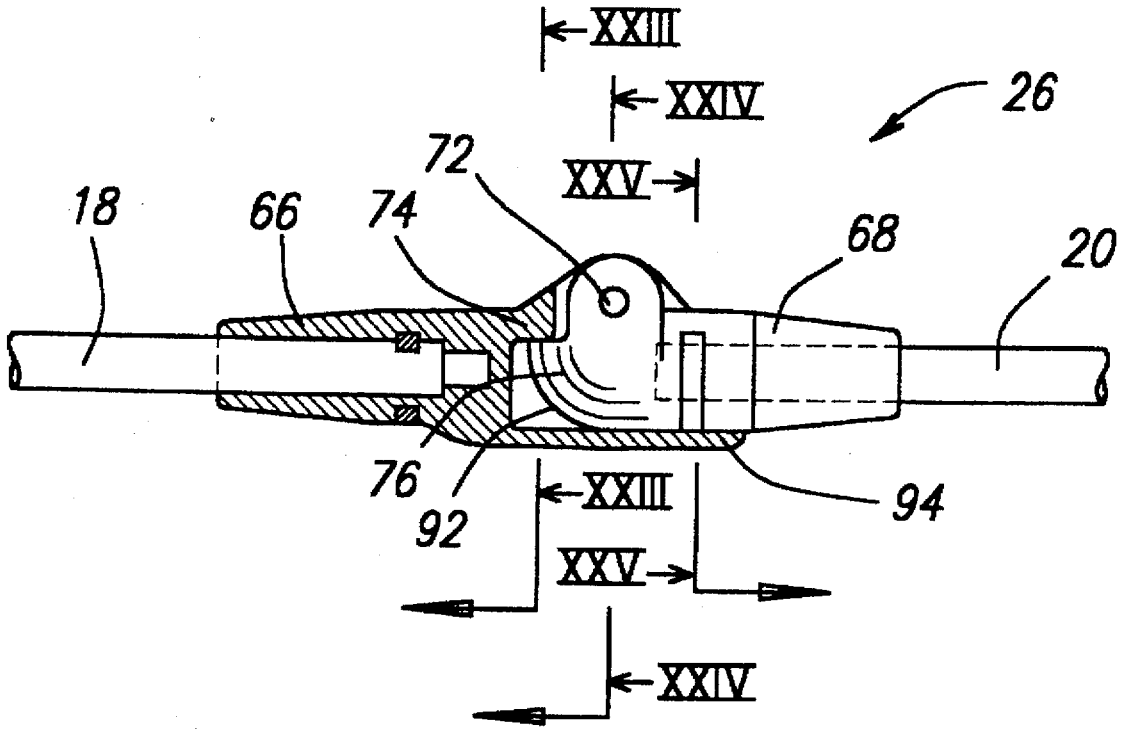
FIG. 22 shows an axial sectional view through the joint shown in FIGS. 18 to 21.
Figure 23:
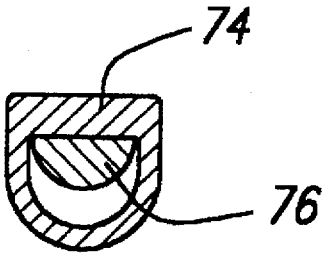
FIG. 23 shows a cross-sectional view of the joint shown in FIGS. 18 to 22 in the plane of the line XXIII—XXIII of FIG. 22.
Figure 24:
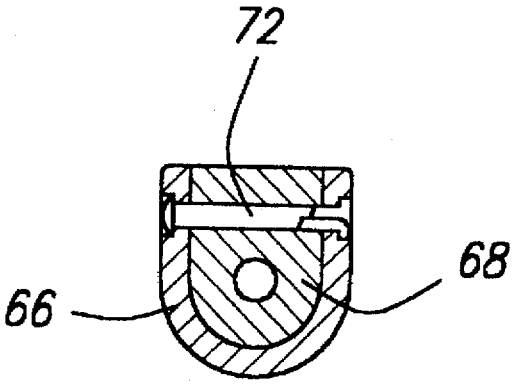
FIG. 24 shows a further cross-section of the joint shown in FIGS. 18 to 22 in the plane indicated by the line XXIV—XXIV of FIG. 22.
Figure 25:
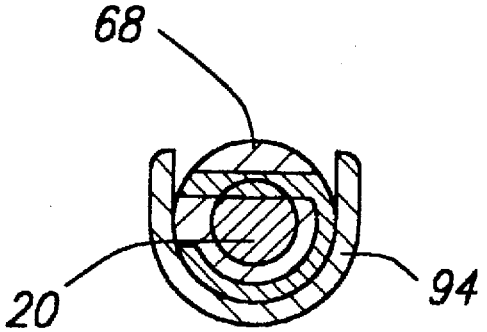
FIG. 25 shows a cross-section through the joint shown in FIGS. 18 to 22 in the plane indicated by the line XXV—XXV of FIG. 22.

To enable such disengagement to happen, the male retaining part 76 is so dimensioned and positioned in relation to the pivot 72 and the female part 74 that a gap 84 is present between the female retaining part 74 and the male retaining part 76 on the pivot side of the joint Furthermore, a transverse end portion 86 which extends from and is integrally moulded with the slider 78 is urged towards the rod section 16 by a helical compression spring 88 provided in a spring cavity 90 of the joint part 68. As a result, the joint 24 may be pushed inwardly towards the tent as shown in FIG. 1 until the gap 84 is closed and the interengaging serrations of the female part 74 and the slider 78 disengage. The slider 78 may now be pulled outwardly from the female retaining part 74 against the restoring force of the compression spring 88. This enables the whole joint now to be folded by pivoting the joint parts 66 and 68 relative to one another about the pivot 72 until the male retaining part 76 is entirely clear of the female retaining part 74. This enables the tent to be dismantled. Upon erection of the tent, the same steps are followed in reverse order. The relative positioning of the two joint parts 66 and 68 when the tent frame is in its collapsed condition is shown in FIG. 17.

Each lower joint 26 shown in FIG. 1 is shown in greater detail in FIGS. 18 to 26. It connects the outer end of the rod section 18 to the upper end of the rod section 20. It has a similar construction to the joint 24, but is simpler. Thus the slider 78, transverse part 86, helical spring 88 and cavity 90 are omitted, and instead the male retaining part 76 has one side rounded off into a curve 92 having its radius of curvature centred on the axis of the pivot 72. Furthermore, the female retaining part 74 is extended in the longitudinal direction on its side further from the pivot 72 to provide an abutment part 94. Finally, it should be noted that the pivot 92 is on the opposite side of the rib 14 relative to the pivot 72 of the joint 24, so that it folds in the opposite sense. Because of this, the flexure of the rib 14 under the tensioning forces of the tent shown in FIG. 1 tend to rotate the rod section 20 in a clockwise sense about the pivot 72 viewing the joint 26 as in FIG. 22. However, the abutment of the male retaining part 76 against the female retaining part 74 inhibits this, as does the abutment of the joint part 68 of the joint 26 against the abutment part 94. At the same time, there is nothing to prevent folding of the joint in the reverse sense upon collapse of the tent, such folding being facilitated by the rounding off of the male retaining part 76.

Figure 27:
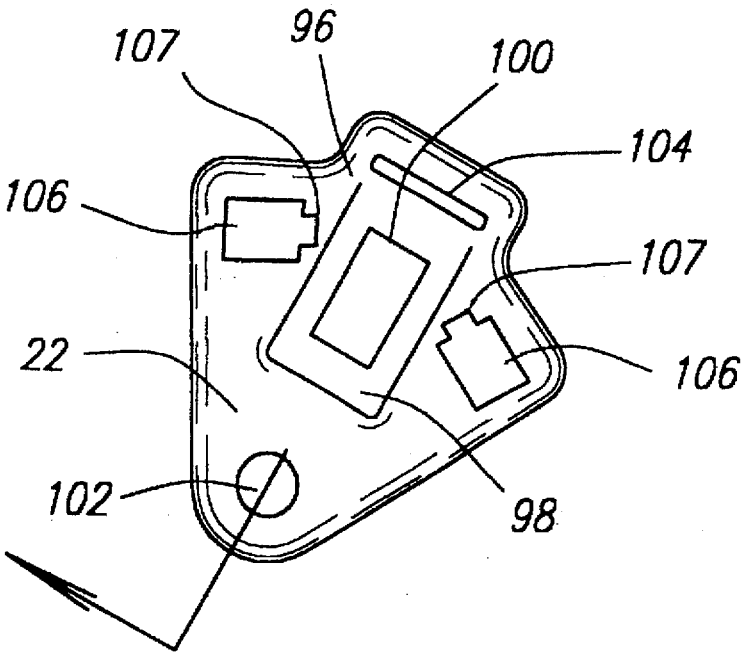
FIG. 27 shows a plan view of a foot of the frame of the tent shown in FIG. 1.
Figure 28:
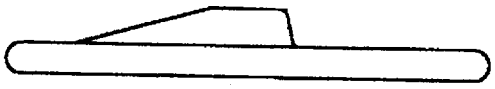
FIG. 28 shows a side view of the foot shown in FIG. 27.
Figure 29:
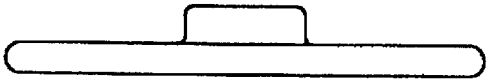
FIG. 29 shows an end view of the foot shown in FIG. 27.

Each foot 22 of the tent frame 10 shown in FIG. 1 is shown in FIGS. 27 to 29. It comprises a synthetic plastics generally arrowhead-shaped pad 96 having a central raised portion 98 which slopes upwardly in an intended outward direction of the pad 22. This sloping portion has a generally rectangular aperture 100 for receiving the bottom end of the associated rib 14. Further apertures which are provided in the pad 96 comprise a generally circular hole 102 at the point of the arrowhead, through which a tent peg can be inserted, an elongate slot 104 at the opposite end of the arrowhead shape for attachment of the fabric sheet material of the tent shown in FIG. 1, and two side apertures 106 for receiving an end of a porch-supporting rod (not shown in FIG. 1). Such a rod may have both ends connected to respective feet to form a hoop to which a porch may be attached.

Figure 30:
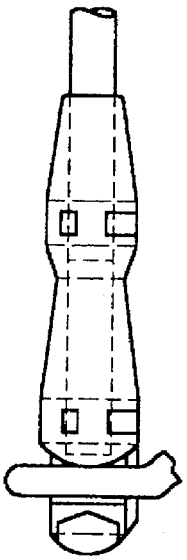
FIG. 30 shows an elevational view of the end of an auxiliary rod (not shown in FIG. 1) connected to the foot shown in FIG. 27.
Figure 31:
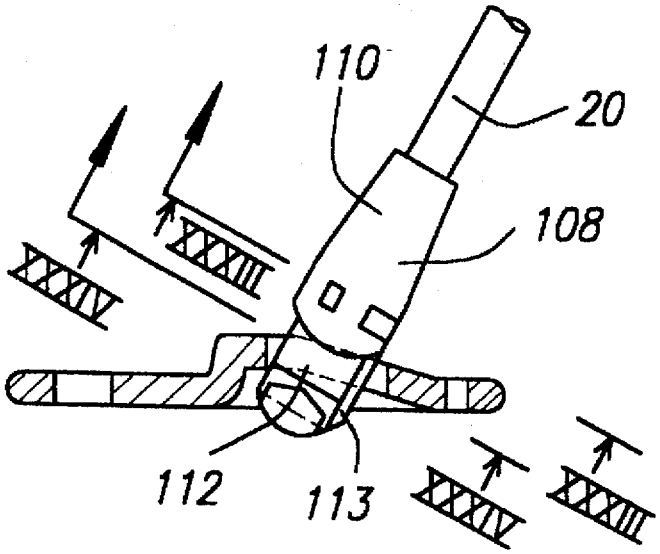
FIG. 31 shows an elevational, partly sectional view of a bottom end of a rib of the frame of the tent shown in FIG. 1 engaging the foot shown in FIG. 27.
Figure 32:
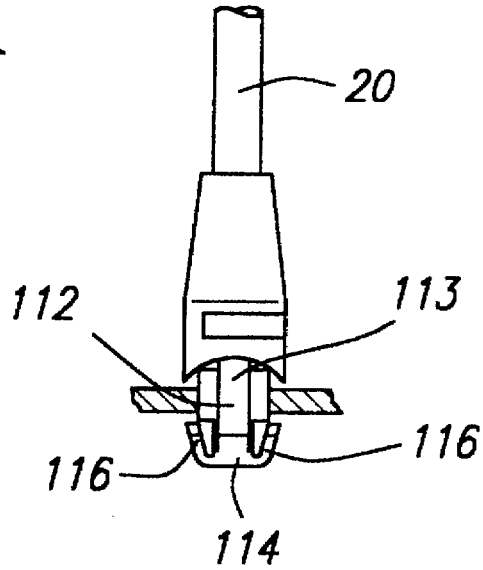
FIG. 32 shows a partially sectional view of the rib end and part of the foot shown in FIG. 31 from a direction of view at right angles to that of FIG. 31.
Figure 33:
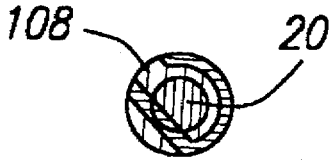
FIG. 33 shows a cross-section through the rib end in the plane indicated by the line XXXIII—XXXIII of FIG. 31.
Figure 34:
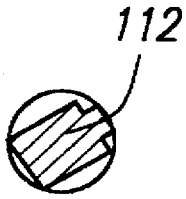
FIG. 34 shows a cross-section through the rib end in the plane XXXIV—XXXIV of FIG. 31.

As shown in FIGS. 31 and 32, the bottom end of each rod section 20 is provided with a foot connector 108. This has a generally hollow cylindrical portion 110 which receives the bottom end of the rod section 20, the latter being connected to the foot connector 108 in the same manner as the inner end of each rod section 16 is connected to the connector 40. The outer end of the foot connector 108 is provided with a synthetic plastics portion 112 which has a head 114 provided with resilient reversed lugs 116 which spring outwardly after the head 114 has been inserted through the aperture 100 so that the lugs 116 abut the underside of the pad 96 and inhibit removal of the foot connector 108 therefrom unless and until the lugs 116 are squeezed together. The ends of the porch rod (not shown in FIG. 1) are provided with foot connectors and are attached to associated feet in substantially the same manner, as shown in FIG. 30.

Figure 26:
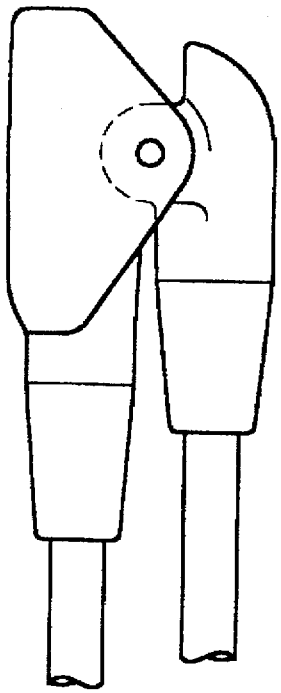
FIG. 26 shows a side view of the joint shown in FIGS. 18 to 22 with the joint in a folded condition.

However, the apertures 106 have locating recesses 107, so that the recesses 107 of respective adjacent pads 96 are engaged by corresponding axially-extending locating protuberances 113 on respective foot connectors 108 at opposite ends of the porch-supporting rod (not shown in FIG. 1). This inhibits rotation of the latter relative to the pads 96, and since the latter are prevented from rotation relative to the ground by the ribs of the tent, the porch-supporting rod cannot rotate about its own axis. This ensures that if the rod is made of two or more sections connected by a simple joint or joints as shown in FIG. 26, so that the rod is collapsible when removed from the pads 96 but is arched against collapse of the joints when attached to the pads 96, the rod is prevented from rotating when thus attached, so that it is inhibited from collapsing accidentally when it is in use.

In addition, because the porch rod is secured at both ends to respective pads 96 that also hold the main ribs, the latter also prevent the pad 96 being lifted from the ground by the resilience of the porch rod.

It will be appreciated that the presence of the apertures 106 symmetrically disposed in the pads 96 enables each pad to be used on both the left-hand side of a porch and the right-hand side thereof.

It is desirable for each pad 96 to have sufficient clearance from the ground to allow any foot connector secured thereto to be free from jamming against the ground. To this end, the pad 96 may be provided with a skirt (not shown) which extends downwardly around its periphery.

Figure 35:
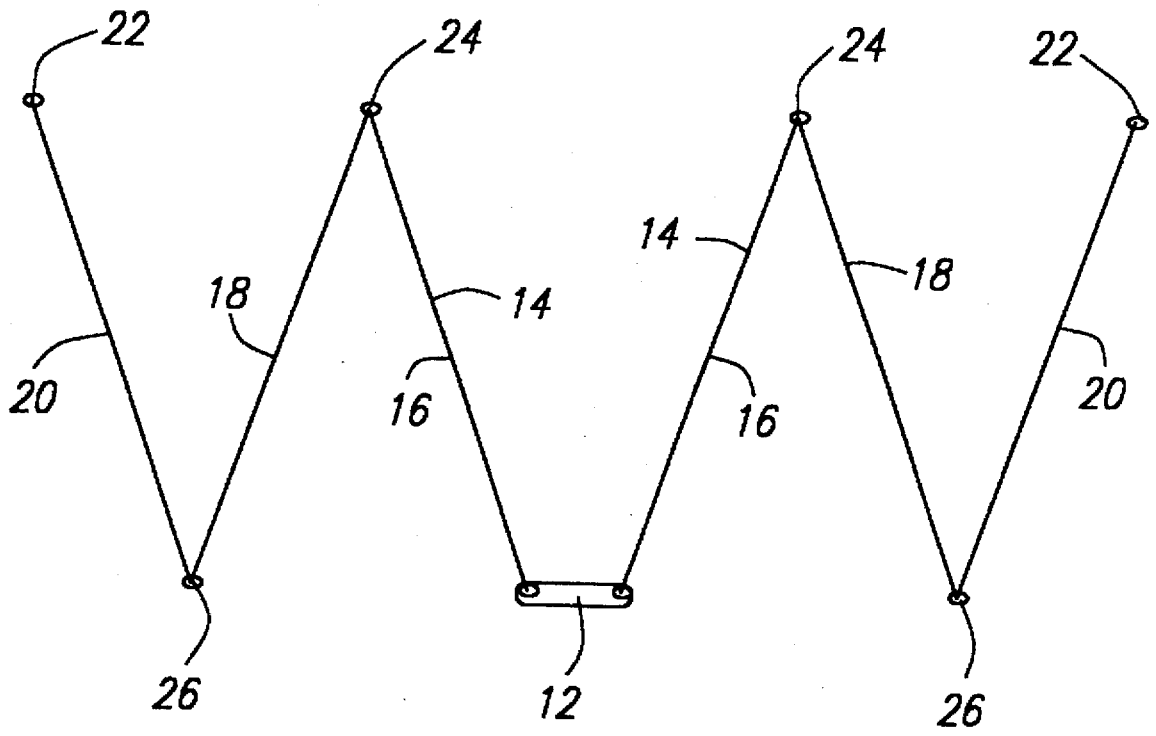
FIG. 35 shows the hub and two ribs of the frame of the tent shown in FIG. 1 in a folded condition.

It will be appreciated, that when the frame of the tent shown in FIG. 1 is collapsed, the hub 12 and two diametrically opposite ribs 14 are folded in the manner shown in FIG. 35, with the upper rod sections 16 being folded upwardly and then towards one another, the rod sections 18 being folded downwardly towards one another about the joints 24, and the rod sections 20 being folded upwardly and towards one another about the joints 26. The whole tent may thus be folded together in a concertina like fashion into a compact generally tubular elongate shape.

Numerous variations and modifications to the illustrated hub, hub connectors, joints, frame and tent may be made to those which have been illustrated, without taking them outside the scope of the present invention. To give one example, inserts may be fitted into the slots 46 after the connector 40 has been attached to the bar 36 to inhibit removal therefrom. Whilst six ribs 14 are shown radiating from the hub 12, any number from three to nine inclusive would be acceptable. The tent sheet material may comprise an inner skin (not shown) to reduce condensation, and a groundsheet (not shown). Whilst the joints or hinging mechanisms are preferably made of Verton™, other plastics materials could be used, or aluminium could be used.

I claim:

1. A tent frame device comprising a hub from which radiates a multiplicity of ribs when the device is in use, in which the hub is provided with a multiplicity of retaining portions which extend in a tangential direction and which are spaced apart around the hub, and a multiplicity of abutment portions positioned outwardly of the retaining portions respectfully, the device further comprising respective rib-end connectors provided with respective recesses which are open in an intended upward direction and which receive the retaining portions respectively when the device is in use, with the underside of the rib-end connectors abutting the abutment portions.

2. A device according to claim 1, in which the retaining portions each comprise a bar having both of its ends attached to the main body of the hub.

3. A device according to claim 2, in which each bar is of generally circular cross-section.

4. A device according to claim 1, in which each retaining portion extends across an associated aperture of the hub.

5. A device according to claim 1, in which the hub is of generally circular shape.

6. A device according to claim 1, in which the abutment portions extend around the periphery of the hub.

7. A device according to claim 1, in which respective retaining inserts are attached to the rib-end connectors over the retaining portions when the latter are received in the said recesses, to inhibit removal of the rib-end connectors from the hub.

8. A device according to claim 1, in which the rib-end connectors are made separately from such ribs, and connected to the intended inner ends of such ribs when in use.

9. A device according to claim 1, in which the rib-end connectors are at least partly hollow and generally cylindrical to receive the intended inner ends of such ribs when in use.

10. A device according to claim 1, in which each of the said recesses in the rib-end connectors comprise a channel which extends transversely of the rib-end connector and which is generally U-shaped in cross-section with the arms of the "U" spaced apart by a distance which is substantially the same as the cross-sectional diameter of the associated retaining portion, thereby to inhibit twisting of the associated rib when the frame is assembled.

11. A tent frame comprising a hub device made in accordance with claim 1, and a multiplicity of ribs which radiate from the hub when the device is in use.

12. A tent frame comprising a device according to claim 1, each rib comprising a plurality of parts which may be folded up against one another, in a given imaginary plane, at least one joint between such parts, in which connectors are also provided at the said at least one joint, each connector having a hollow portion for receiving a rib-end, and in which at least an inner part of each rib is provided at its ends with formations which may be brought into registration with formations which are in the hub and the joint connectors, to ensure a correct orientation of the joint relative to the hub, by inhibiting twisting of the associated rib when the frame is in use.

13. A tent frame according to claim 12, in which at least the inner part of each rib is provided at both ends with formations which comprise respective apertures into which a portion of a circlip may be inserted.

14. A tent comprising a tent frame according to claim 11, in which the ribs are attached to the hub to extend outwardly therefrom and downwardly therefrom with sheet material being attached to the frame to create a tent with the frame outside and above it.

15. A tent comprising a tent frame according to claim 12, in which the ribs are attached to the hub to extend outwardly therefrom and downwardly therefrom with sheet material being attached to the frame to create a tent with the frame outside and above it.

* * * * *